United States Patent [19]

Jones

[11] 4,300,853

[45] Nov. 17, 1981

[54] PLASTICIZER MIXER AND METHOD

[75] Inventor: George M. Jones, Salt Lake City, Utah

[73] Assignee: James A. Jackson, Sr., Little Rock, Ark.

[21] Appl. No.: 778,337

[22] Filed: Mar. 17, 1977

[51] Int. Cl.[3] ..... E01C 23/12

[52] U.S. Cl. ..... 404/92; 172/600; 172/584; 404/101; 404/108

[58] Field of Search ..... 404/92, 91, 90, 95, 404/132, 122, 101, 75, 77; 172/599, 600, 587, 586

[56] References Cited

U.S. PATENT DOCUMENTS

| | | | |
|---|---|---|---|
| Re. 28,271 | 12/1974 | Lehman | 172/586 X |
| 1,802,087 | 4/1931 | McConnaughay | 404/92 |
| 1,843,275 | 2/1932 | Furrer | 172/586 |
| 1,938,023 | 12/1933 | Ingalls | 404/90 |
| 2,053,709 | 9/1936 | Flynn | 404/90 X |
| 2,093,766 | 9/1937 | Rich | 404/90 |
| 2,138,904 | 12/1938 | Carswell | 404/92 X |
| 2,181,320 | 11/1939 | Flynn | 404/92 |
| 2,254,463 | 9/1941 | Wells | 404/95 |
| 2,394,017 | 2/1946 | Seaman | 404/95 |
| 3,055,280 | 9/1962 | Neville | 404/95 |
| 3,094,315 | 6/1963 | Yetter | 404/90 X |
| 3,223,178 | 12/1965 | Clifford | 172/600 X |
| 3,361,042 | 1/1968 | Cutler | 404/95 X |
| 3,970,404 | 7/1976 | Benedetti | 404/77 |

*Primary Examiner*—Nile C. Byers, Jr.

*Attorney, Agent, or Firm*—Hubbard, Thurman, Turner, Tucker & Glaser

[57] ABSTRACT

Apparatus for use in combination with a road working machine for mixing a liquid plasticizing agent within a layer of scarified road surface materal is disclosed. The apparatus includes an array of discs for lifting and turning the scarified road surface material and a nozzle supported in a position for spraying the liquid plasticizing agent upon the road surface material as it is lifted and turned by the discs. In a preferred embodiment, the discs are secured to a rotatable shaft which is mounted for angular movement through a plane lying transverse to the direction of travel so that the disc assembly may follow longitudinal undulations in the road surface. A method for restoring a paved road surface which may be carried out by the apparatus described above includes the steps of scarifying a heated road surface to break up the road surface material, turning the scarified road surface material with the disc assembly and simultaneously mixing a liquid plasticizing agent with the scarified road material as it is turned. Thereafter, the mixture of the plasticizing agent and scarified road surface material is screeded to proper contour and compacted to form a smooth roadway surface.

3 Claims, 9 Drawing Figures

PLASTICIZER MIXER AND METHOD

BACKGROUND OF THE INVENTION

1. Field of the Invention

The present invention is related generally to road conditioning apparatus and methods for reworking or restoring road surfaces, and more particularly, to method and apparatus for mixing a liquid plasticizer agent into a layer of scarified road surface material which is to be restored.

2. Description of the Prior Art

Asphalt and other bituminous materials have long been used to form smooth roadway pavement surfaces. Over a period of time, weathering and extensive use of the roadways will render the pavement surface hard and brittle, resulting in irregularities and cracking in the pavement. Cracks due to shrinkage of the pavement may develop allowing water penetration to cause further deterioration of the roadway surface. Once started, pavement deterioration increases at an accelerated rate and, unless prompt action is taken, complete reconstruction may be required. The breakdown of pavement structure may be further accelerated by the lack of proper drainage or by the presence of corrosive foreign matter, such as chemicals or road salts. Improper construction, such as the use of too little or too much asphaltic binder, an unsatisfactory grade of aggregate or inadequate compaction may cause further pavement deterioration.

The pavement deterioration is caused in part by the effect of ultraviolet radiation from the sun which causes the bituminous material to undergo a chemical reaction which changes its physical properties, and in particular causes it to lose its resiliency. This hardening effect causes cracks to form in the road surface which may become filled with an incompressible material such as sand. A conventional repair procedure is to remove the sand from the cracks by the application of compressed air and filling the cracks with asphalt.

Experience has shown that hardening of the asphalt material occurs principally in the top inch of the pavement. Improved road working apparatus and equipment have been developed to recondition and if necessary remove this weathered, hardened layer of pavement. A conventional system utilizes heating apparatus to soften the pavement, followed by apparatus to plane the surface and remove the planed material from the roadway. In some cases an additional layer of bituminous material is spread over the reworked surface and the mixture is compressed by compacting equipment.

A basic problem in restoring hardened road surfaces by raking or scarifying has been in restoring the resiliency of the asphalt in the scarified layer. One approach has been to apply intense heat to penetrate through the hardened layer prior to scarifying in order to draw the asphaltic cement or binder to the surface and recoat the aggregate that has become barren from traffic wear. During this procedure the heat softens the mixture sufficiently to enable the scarifier to loosen and stir the material. Intense heat must be applied to obtain sufficient heat penetration through the hardened pavement surface because of the low heat conductivity of the asphalt. However, the intense heat required to draw the asphaltic cement or binder to the surface cannot be applied for a sufficiently long period since the asphalt burns at a relatively low temperature. Such asphalt burning may result in damage sufficiently severe to prevent reuse of the asphalt for resurfacing purposes.

To overcome the heating problem maintenance machines have been utilized to make multiple passes over the same section of roadway in order to heat and work the pavement to a sufficient depth without burning the asphalt. However, this procedure is inefficient and time-consuming.

One approach to restoring the resiliency of the hardened layer is to alternately heat the paved surface and allow the surface to partially cool until the surface has been heated and softened to a predetermined depth while maintaining the temperature of the surface below a predetermined limit. In combination with this procedure, after the softened layer has been scarified, a plasticizing agent comprising petroleum products is sprayed upon the exposed top surface of the scarified layer of pavement to rejuvenate the hardened asphalt. The distributor is typically a tank carried on a truck which follows the scarifier and thus delays the application of the roller which compacts the scarified pavement. Experience has demonstrated that the plasticizing agent when sprayed upon the scarified pavement in that manner will not effectively penetrate the scarified layer. Therefore, only the exposed surface of the scarified material is coated with the plasticizing agent. During the period that the plasticizing agent is being sprayed upon the exposed surface of the scarified material, the temperature of the pavement generally decreases. If the temperature decreases sufficiently, the viscosity of the asphalt increases beyond the point at which adequate compaction is possible. Therefore there is needed apparatus for use with a road working machine for mixing the rejuvenating agent uniformly throughout the scarified layer so that surface compaction can be carried out with minimum delay after heating has occurred.

SUMMARY OF THE INVENTION

The present invention is directed to road conditioning apparatus and methods for reworking and restoring road surfaces. More particularly, apparatus for mixing a liquid plasticizing agent within a layer of scarified road surface material which may be attached to a general purpose roadway maintenance machine is disclosed.

According to an important aspect of the present invention, the mixing apparatus is equipped with an array of disc assemblies for penetrating the scarified layer and for lifting and turning the scarified material. A spray nozzle is suspended in front of selected ones of the disc assemblies and is aimed to direct the flow of a liquid plasticizing agent upon the scarified road surface material turned by the discs. The disc assemblies are rotatable about a longitudinal axis and are also mounted for angular movement with respect to the line of travel so that the disc assemblies can follow longitudinal undulations or ruts in the road surface.

According to the method of the invention, the scarified road surface material is penetrated by the discs which lift and laterally displace portions of the scarified material. A liquid plasticizing agent is simultaneously sprayed over the scarified material as it is lifted and turned by the discs so that the liquid plasticizing agent is distributed substantially uniformly and becomes coated substantially uniformly over all surfaces of the scarified material as it is lifted and turned.

BRIEF DESCRIPTION OF THE DRAWING

The novel features which characterize the invention are set forth in the appended claims. The invention itself, however, as well as other objects and advantages thereof, may best be understood by reference to the following detailed description of a preferred embodiment, when read in conjunction with the accompanying drawing, wherein:

DETAILED DESCRIPTION

Figure 1:
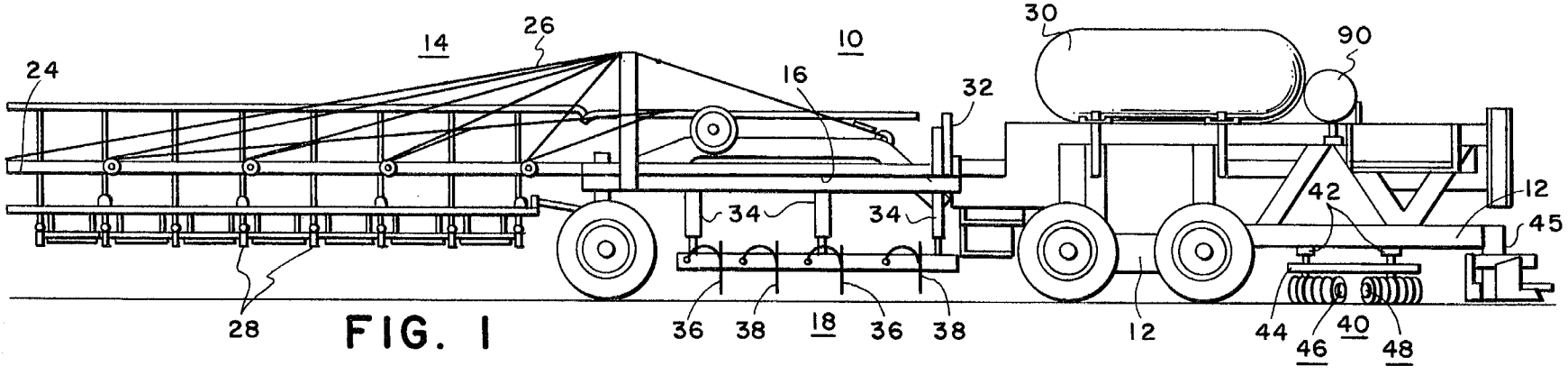
FIG. 1 is a side elevation of a road maintenance machine which incorporates mixing apparatus constructed according to the teachings of the present invention.

Referring now to FIG. 1, a road maintenance machine 10 includes a chassis 12 having a burner assembly 14 attached to the front portion of the chassis. The middle section of the chassis 12 is provided with convertible gear means 16 for the attachment of various devices depending upon the type of maintenance work needed. As shown in FIG. 1, a scarifier assembly 18 constructed according to conventional design is attached to gear means 16 in road surface engagement position. The chassis 12 may be a modified form of a standard road grading machine with the drive assembly gear ratio being modified to provide the necessary operating speeds. The burner assembly 14 may be conventional in design and is supported by two chassis booms 24 which project in front of the machine 10 parallel to the roadway and mechanically connected to the chassis 12 by conventional means. The booms 24 are supported by a plurality of tension cables 26 at various points along the boom. The burner assembly 14 is provided with multiple rows of burner units 28, preferably including two units per row. Each burner row 28 is suspended parallel to the ground and spaced horizontally apart from the adjacent rows along the direction of travel. Fuel for the burner assembly 14 is applied under pressure from a large tank 30 mounted on the chassis 12. Fuel is distributed to each burner unit 28 by a hose (not shown) running from a distribution manifold 32.

The scarifier 18 is connected to hydraulic or mechanical lifts 34 and is disposed horizontally to the ground and extends underneath the chassis 12 above the pavement area previously covered by the burner assembly 14. Two or more rows of scarifier teeth 36, 38 are provided for raking the pavement heated by the burner assembly 28. A preferred embodiment of the scarifier assembly is provided with the rows of teeth 36, 38 each being eight feet wide. However, both burners and scarifiers may be extended laterally to treat pavement of various widths greater than eight feet. The scarifier teeth preferably are eighteen inches long, having a $\frac{5}{8}$ inch by $\frac{7}{8}$ inch diamond cross section and are disposed on two-inch centers. Successive rows of teeth are offset to provide one inch grooved spacing over the full width of the scarifier unit.

A more complete description of a road maintenance machine and its various road working attachments with which the present invention may be used in combination to good advantage may be found in the co-pending U.S. application Ser. No. 448,404, entitled "Road Maintenance Machine and Methods" filed Mar. 5, 1974 by James A. Jackson, Sr., the assignee of the present invention, which application is hereby incorporated by reference.

A plasticizer mixer assembly 40 constructed according to the invention is shown secured to hydraulic or mechanical lifts 42 at the rear of the road working machine 10 underneath the chassis 12. The mixer assembly 40 includes a box frame 44 and disc assemblies 46, 48 supported by the frame 44. An oscillating screed 45 is also attached to the chassis 12 and is operable to level the scarified material after it has received the plasticizing agent.

Figure 2:
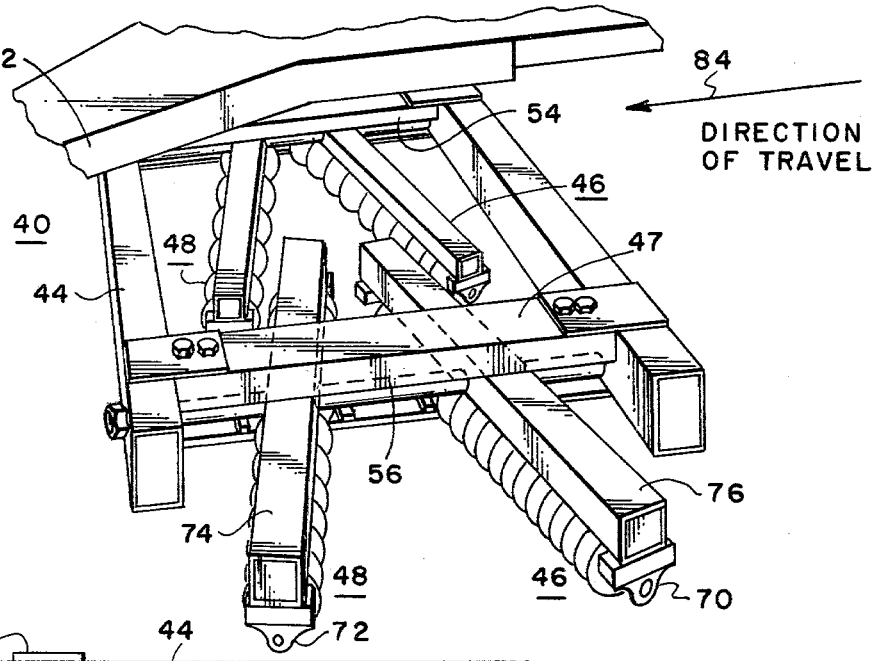
FIG. 2 is an isometric view of the mixing apparatus shown in FIG. 1.
Figure 4:
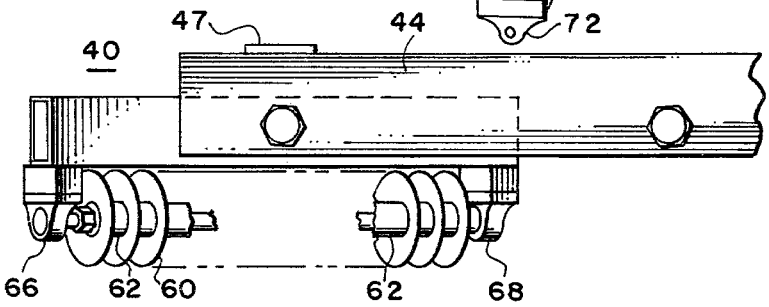
FIG. 4 is an elevation view, partly in section, taken along the lines IV—IV of FIG. 3.

Referring now to FIG. 2 of the drawing, details of the mixer assembly 40 are shown in an enlarged isometric view. The frame 44 which supports the disc assemblies is seen to be rectangular in outline and is supported by means of the hydraulic or mechanical lifts 42 horizontally with respect to the road surface. The frame 44 may be rigidly attached to the chassis 12; however, it is preferably supported by the hydraulic or mechanical lifts 42 so that the mixer assembly can be lifted from the road surface when it is necessary to turn the road working machine 10 around. Beams 50, 52, 54 and 56 are secured to cross bar members 47 of the frame 44 in spaced relation with respect to each other and parallel to the line of travel of the frame 44 as it is carried by the road working imachine 10. The crossbar members 47 stabilize the assembly and prevent excessive rotation of the disc assemblies 46 and 48 about the beams 50, 52, 54 and 56.

Figure 5:
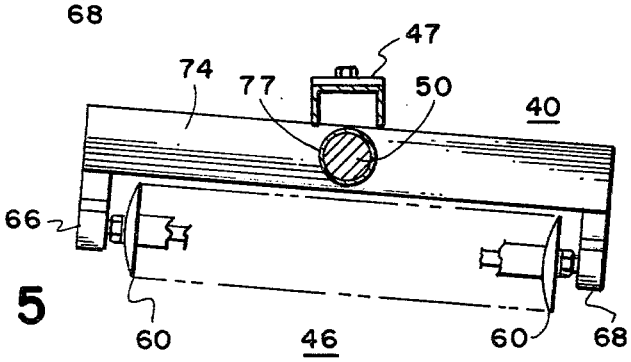
FIG. 5 is an elevation view, partly in section, taken along the lines V—V of FIG. 3.
Figure 6:
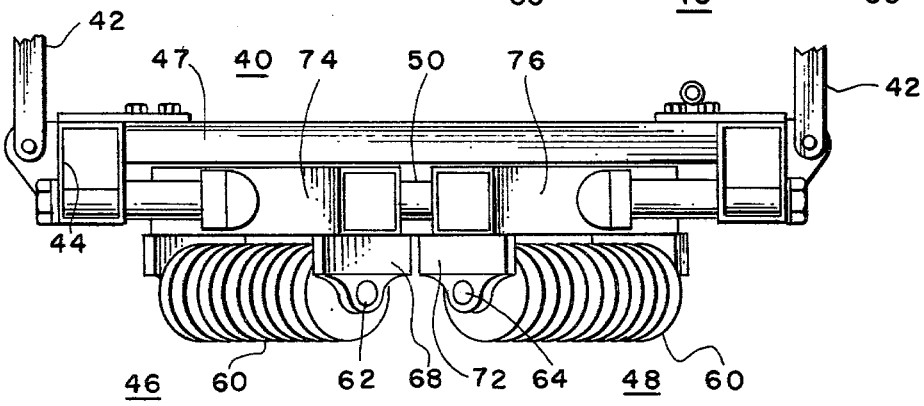
FIG. 6 is an elevation view of the mixing apparatus of FIG. 3 taken along the line VI—VI.
Figure 3:
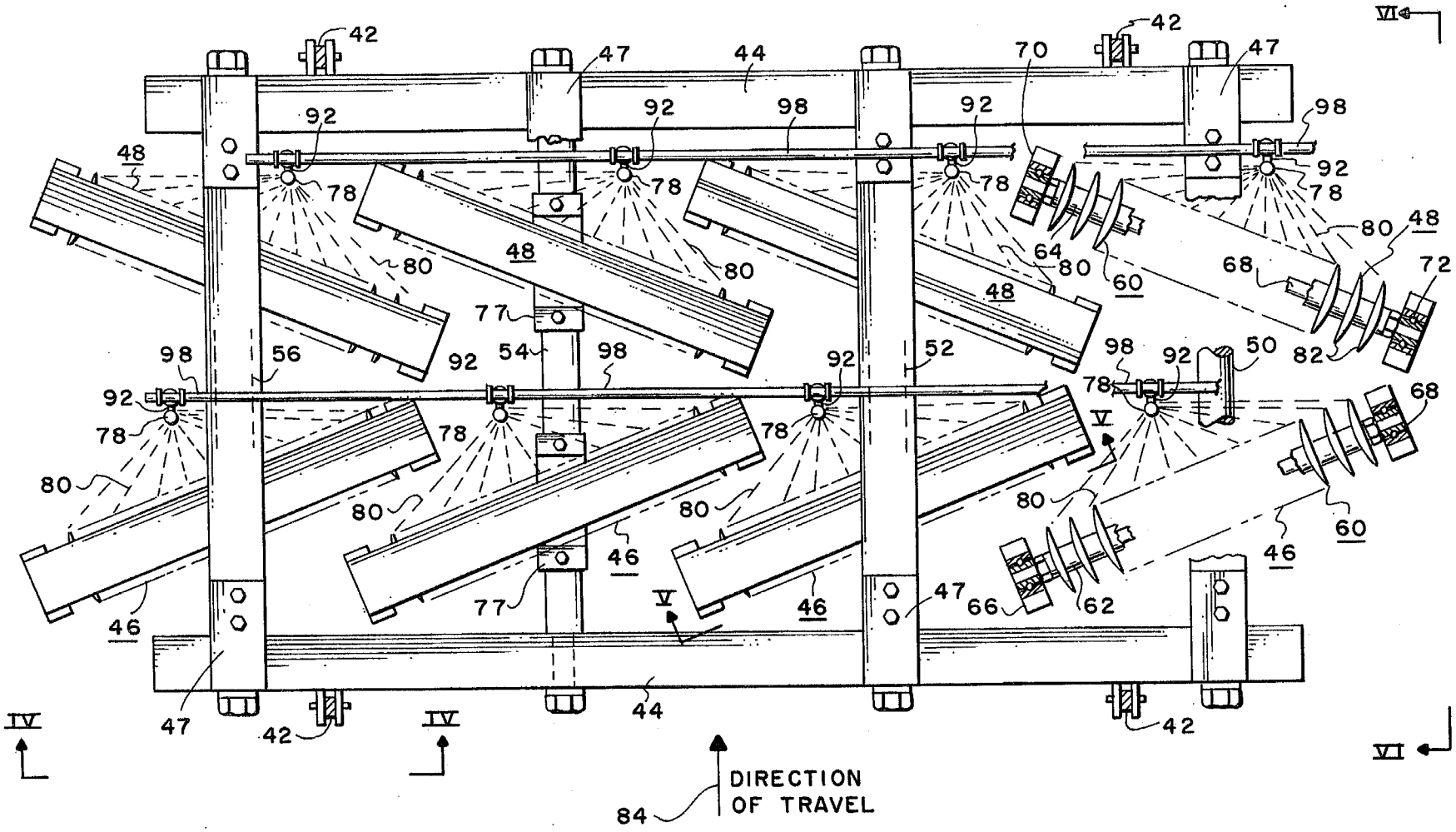
FIG. 3 is a plan view of the mixing apparatus of FIG. 2.

A pair of disc assemblies 46, 48 is secured to each beam in spaced relation and are obliquely oriented with respect to the axis of the beam to which they are attached as can best be seen in FIG. 3 of the drawing. Each disc assembly 46, 48 includes an array of discs 60 secured to a rotatable shaft 62, 64 respectively. Each shaft 62, 64 is journalled for rotation in bearing members 66, 68 and 70, 72 respectively. The disc assemblies 46, 48 are mechanically coupled to the frame 44 through a yoke 74, 76 in which the bearing members 66, 68 and 70, 72 are disposed. As best seen in FIGS. 3 and 5, the beam 50 is mounted within a bearing 77 carried by the yokes 74, 76 for angular movement with respect to the longitudinal axis of the beam. This arrangement permits the disc assembly 60 to follow longitudinal ruts in the road surface. The yokes 74, 76 may be filled with a heavy material such as lead to improve the penetrating ability of the discs.

The disc assemblies 46, 48 are secured obliquely with respect to each other and with respect to the beam 50. Corresponding disc assemblies 48 secured to the adjacent beams 52, 54 and 56 are arranged in parallel with respect to each other. Similarly, the corresponding disc assemblies 46 secured to the beams 52, 54 and 56 are also disposed in parallel relation with respect to each other.

Figure 9:
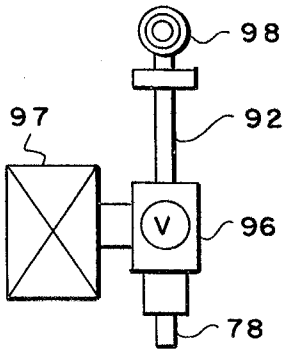
FIG. 9 is an elevation view of a cutoff valve and spray nozzle assembly.

Referring now to FIGS. 3 and 9, a spray nozzle 78 is suspended in front of each disc assembly to direct the flow of a liquid plasticizing agent onto the road surface material turned by the discs 60. A typical spray pattern is illustrated by the dashed lines 80 which are directed onto the leading edge of the discs which turn the scarified bituminous road material. In addition to enhancing the mixing action, this arrangement will prevent fouling of the discs.

According to an important feature of the invention, the discs 60 of each array are concave and have inclined edge portions 82 extending in the same direction with respect to the line of travel as indicated by the arrow 84. The discs 60 of the adjacent assembly 48 are also concave but have their inclined edges 82 extending in a direction laterally opposite to the orientation of the concave discs 60 of the assembly 46. By this arrangement, the scarified road surface material is turned first in one direction by the discs 60 of the disc assembly 46 and are coated with a plasticizing agent by the nozzle 78 and then are subsequently turned in the laterally opposite direction by the discs 60 of the disc assembly 48 so that the remaining surfaces of the scarified material are coated.

This arrangement ensures that the liquid plasticizing agent will be distributed uniformly throughout the scarified layer and will be coated over all exposed surfaces of the scarified material. The liquid plasticizing agent may be conveniently stored in a tank 90 supported on the chassis 12 as shown in FIG. 1 of the drawing. The liquid plasticizing agent is supplied to the nozzles 78 under pressure through the conduit 92. The conduit 92 is connected in fluid communication and in series fluid relation with a cutoff valve 96 which is in turn connected to a manifold 98 as shown in FIG. 9. The cutoff valve 96 is operated electrically by a solenoid 97 to cut off the flow of the liquid plasticizing agent when it is necessary to stop the road working machine 10 in order to prevent an unusually heavy application of the liquid plasticizing agent while the road working machine 10 is stopped. To reduce the viscosity of the plasticizing agent, prior to its application to the road, it may be heated by any conventional means.

Figure 7:
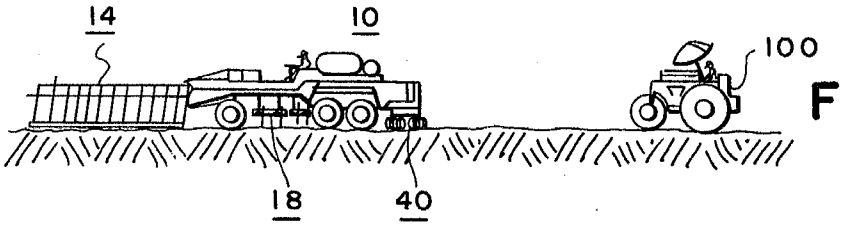
FIG. 7 is an elevation view which illustrates the operation of the mixing apparatus of FIG. 3 in combination with the road maintenance machine of FIG. 1.

In situations where the existing surface is reusable by substantial resurfacing is required, the asphalt scarifying method shown in FIG. 7 may be used. The existing surface is softened with heat by the burner assembly 14 which heats the pavement to a depth of $\frac{1}{2}$ to $\frac{3}{4}$ inch. After the pavement is thoroughly heated, but without burning the asphalt surface, the scarifier assembly 18 thoroughly penetrates and rakes the pavement surface to the heated depth to prepare the surface for paving. According to the method of the present invention, the scarified road surface material is turned and mixed with a liquid plasticizing agent by means of the mixer assembly 40 in order to ensure that the plasticizing agent is distributed uniformly throughout the scarified layer. The liquid plasticizing agent is distributed uniformly at a suitable rate, for example in the amount of 0.02 to 0.20 gallons per square yard. The final step is compaction of the mixture of the plasticizing agent and scarified road surface material by a roller machine 100 to form a level surface.

Figure 8:
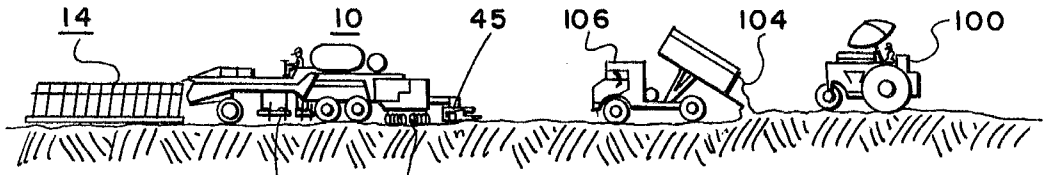
FIG. 8 is a view similar to FIG. 7.

A variation of the asphalt scarifying method as shown in FIG. 8 of the drawing is to partially compact and level the mixed material with the oscillating screed 45 prior to performing the final compacting step. The screed procedure eliminates cracks and restores it to proper contour, prolongs the life of the pavement and restores skid resistance. In addition, it may be desirable in some instances to augment the rejuvenated layer by covering it with a course of asphaltic concrete 104. The additional material 104 should be spread over the pavement surface preferably by a bituminous paver, or by a truck 106 equipped with a spreader box. The final step of compaction is then carried out by the roller machine 100.

The process of compacting new material together with the heated, rejuvenated and reworked paving material results in a new, homogeneous pavement surface having excellent cohesion and resiliency characteristics. The newly laid aggregate material becomes integral with the rejuvenated surface and minimizes the disjuncture at the point of resurfacing. Because the liquid plasticizing agent is mixed uniformly throughout the scarified layer, the asphaltic material becomes rejuvenated or plasticized which improves it resiliency. The absence of a fissure or plane of cleavage between the two layers of surfacing eliminates the possibility of moisture propagating through under surface cracks and causing rapid deterioration of the pavement.

In the preferred method, the surface is heated and scarified to a depth of $\frac{3}{4}$ inch. The amount of plasticizing agent or emulsified asphalt applied to a scarified pavement must be accurately determined by laboratory tests. The application should be as heavy as possible to provide the maximum possible softening of the in situ asphalt without making the pavement unstable. Thus the residual asphalt plus the asphaltic component of the liquid plasticizer or emulsified asphalt must be limited according to this requirement. The treated, scarified pavement may then be covered by an open graded friction course or a regular dense grade paving course having the necessary thickness to support the projected traffic load. Compaction is achieved by using the roller machine 100 resulting in a new surface which is homogeneously bonded to the existing scarified surface of the pavement.

Although a preferred embodiment of the invention has been described in detail, it should be understood that various changes, substitutions, and alterations can be made therein without departing from the spirit and scope of the invention as defined by the appended claims.

What is claimed is:

1. A road surfacing machine comprising, in combination a chassis frame having front and rear sets of wheels;

a burner assembly suspended in front of said chassis frame at a predetermined distance above the road surface for heating a plurality of spaced strips along the surface transverse to the road whereby the surface is heated and softened to a predetermined depth while maintaining the heated surface layer below a predetermined temperature by moving the machine along the road surface;

a scarifier assembly adjustably attached beneath the chassis frame behind the burner assembly for raking the heated and softened road surface to substantially the predetermined depth;

a plurality of beams secured to the chassis frame in spaced relation and parallel to the line of travel of the frame as it is carried along the road surface;

a plurality of disc assemblies for lifting and turning portions of the scarified road surface material, each including a yoke, a shaft journalled for rotation on the yoke, and a plurality of discs secured to the shaft, each yoke being mechanically coupled to one of said beams for angular movement with respect to the longitudinal axis of the beam thereby permitting each disc assembly to rotate about its longitudinal axis and also to move angularly with respect to the axis of the beam to which it is attached in response to variations in the elevation of the road surface engaged by the disc assembly; and, a spray nozzle suspended beneath the chassis and near each disc assembly, the nozzle being aimed to spray a liquid plasticizing agent over exposed surfaces of the scarified road surface material as it is lifted and turned by the disc assemblies, whereby the liquid plasticizing agent is coated substantially uniformly over the exposed surfaces of the scarified road surface material throughout the heated layer.

2. The road surfacing machine as defined in claim 1, a plurality of said disc assemblies being coupled to each of said beams, the disc assemblies of each beam being secured thereto obliquely with respect to each other, and corresponding disc assemblies of adjacent beams being disposed in parallel relation with respect to each other.

3. The road surfacing machine as defined in claim 2, the discs being concave, and all discs in a single assembly being concave with respect to a selected reference, the discs of adjacent assemblies secured to the same beam being concave in a direction which is laterally opposite to the concave orientation of the adjacent disc assembly.

* * * * *